United States Patent [19]

Cifalde

[11] 4,206,961

[45] Jun. 10, 1980

[54] EXTENSION CORD CLIP

[76] Inventor: William A. Cifalde, 1715 Warner Rd. SE., Hubbard, Ohio 44425

[21] Appl. No.: 46,301

[22] Filed: Jun. 7, 1979

[51] Int. Cl.[2] ..... H01R 13/54

[52] U.S. Cl. ..... 339/75 P

[58] Field of Search ..... 339/103 R, 104, 105, 339/135, 107, 75 P

[56] References Cited

U.S. PATENT DOCUMENTS

| | | | |
|---|---|---|---|
| 1,914,993 | 6/1933 | D'Olier | 339/135 |
| 2,721,313 | 10/1955 | English | 339/75 P |
| 3,922,055 | 11/1975 | McGregor | 339/105 |

*Primary Examiner*—Joseph H. McGlynn
*Assistant Examiner*—John S. Brown
*Attorney, Agent, or Firm*—Webster B. Harpman

[57] ABSTRACT

A device which prevents the accidental disconnection of electrical cord connector ends from one another as found in extension cords and power tools comprises an elongated rod having closely spaced resilient convolutions forming coils on either end thereof. The extension cords on either side of their connected ends are engaged between the convolutions thereby preventing the accidental disconnection of the connector ends from one another.

5 Claims, 4 Drawing Figures

EXTENSION CORD CLIP

BACKGROUND OF THE INVENTION (1) Field of the Invention

This invention relates to electrical cord clips of the type that prevent accidental disconnection of connected electrical extension cords and the like.

(2) Description of the Prior Art

Prior cord holding devices have comprised spring or metal clips of various designs. See for example U.S. Pat. Nos. 3,611,265 and 3,922,055.

In U.S. Pat. No. 3,611,265 a cord holder is disclosed wherein the embodiment of FIG. 3 has a large center loop of spring steel wire with two V-shaped projections formed thereon. The connector ends on the cords engage the V-shaped projections and are thereby held in engagement.

In applicant's device an elongated resilient rod having resilient coil-like convolutions on its ends clampingly holds each of the extension cords preventing separation of the connected ends.

In U.S. Pat. No. 3,922,055 a rod has spiral turns in it opposite ends. The electrical cords are wound around the turns and connected therebetween where a mechanical clamp holds the connections together. Applicant's device has a pair of closely spaced convolutions forming coils on each end of a resilient rod, the spaces between the convolutions hold the cords inserted therein by friction engagement thus transferring tension on the cords from one cord to the other by way of the device.

SUMMARY OF THE INVENTION

An extension cord clip comprises an elongated rod having oppositely disposed resilient coil-like convolutions on either end thereof. The convolutions act as spring clips in holding a pair of extension cords in end to end alignment with their respective mated male and female ends therebetween. When the cords are positioned between the convolutions accidental disconnection of the mated ends will be prevented. The convolutions themselves are integrally formed from the resilient rod and allow only the cord portion of the extension cords or electrical tools to be inserted therebetween where they are held by the spring action of the coil-like convolutions of the device.

DESCRIPTION OF THE PREFERRED EMBODIMENT

Figure 1:
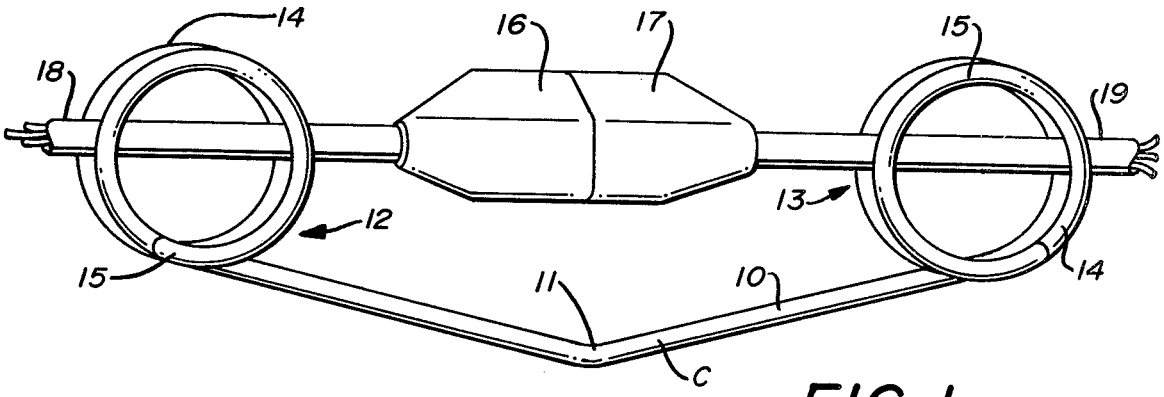
FIG. 1 is a perspective view of the cord clip showing connected electrical cords therein.
Figure 2:
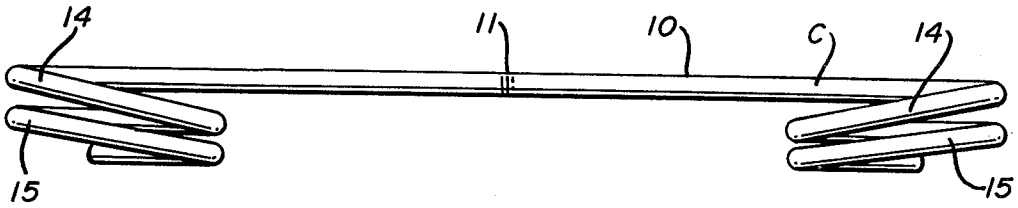
FIG. 2 is a top view of the cord clip.
Figure 4:
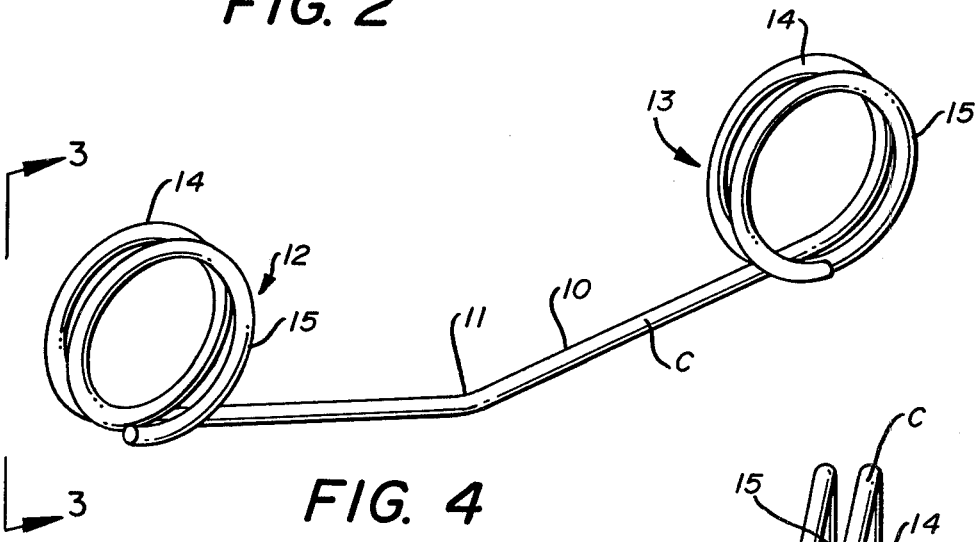
FIG. 4 is a perspective view thereof.
Figure 3:
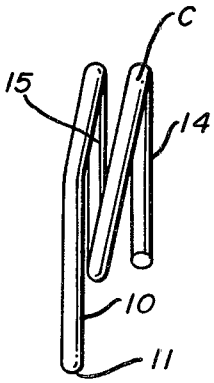
FIG. 3 is an end view thereof.

In the form of the invention chosen for illustration herein, the extension cord clip is shown in use in FIG. 1 and in FIGS. 2, 3 and 4 of the drawings will be seen to comprise an elongated angular resilient steel rod 10 having a center portion 11 with oppositely disposed coiled ends 12 and 13. Each of the coiled ends 12 and 13 comprises two or more closely spaced circular convolutions 14 and 15. The intermediate rod 11 forms a resilient connection between the oppositely disposed convolutions 14 and 15. The rod 10 and the coiled ends 12 and 13 are preferably formed of spring steel and provided with an enveloping coating of a resilient plastic or a rubber material C. The rod 10 is of a flat V-shape.

By referring now to FIG. 1 of the drawings it will be seen that the two spaced coiled ends 12 and 13 lie on a common plane which is offset from the center portion 11 of the rod 10 to allow for easy alignment and engagement of connectors 16 and 17 on the ends of extension cords 18 and 19. In use the connectors 16 and 17 are connected to one another and positioned in the extension cord clip between the coiled ends 12 and 13 and alongside the angular resilient rod 10 and its middle section 11 and the extension cords 18 and 19 are engaged between the convolutions 14 and 15 of the coiled ends 12 and 13. The coating C of resilient plastic or rubber-like material provides satisfactory frictional contact between the convolutions 14 and 15 of the coiled ends 12 and 13 to prevent accidental movement of the cords 18 and 19 and the connectors 16 and 17 accordingly remain engaged as movement of one of the cords is transferred to the other by the device of the invention rather than through the connectors 16 and 17.

It will thus be seen that the invention provides a single, simple, inexpensive device that can be used with a variety of commercially available power tools and extension cords and that it will prevent the accidental disconnection of the cord connection ends from one another.

As disclosed and described hereinbefore the extension cord clip locates the coiled ends 12 and 13 of the resilient rod 10 a sufficient distance to enable the connector ends 16 and 17 of the electrical cords 18 and 19 to be spaced with respect to one another, it will be understood that the coiled ends 12 and 13 can be positioned relatively close to one another so that there is only sufficient space for the connection ends 16 and 17 therebetween when in engaged position. In such a modification the structures of the connector ends 16 and 17 will abut and engage the coiled ends 12 and 13 and thus insure against their accidental disconnection by such engagement which cooperates with the frictional engagement of the convolutions 14 and 15 of the coiled ends 12 and 13 engagement with the cords 18 and 19.

It will thus be seen that a new and useful device has been disclosed and although one embodiment of the present invention has been illustrated and described, it will be apparent to those skilled in the art that various modifications and changes may be made therein without departing from the spirit of the invention and having thus described my invention what I claim is:

1. An extension cord clip for holding the connection ends of extension cords and the like in connected relation comprising a rod having coiled ends formed thereon in offset relation to the center portion of the rod, said coiled ends formed of closely spaced convolutions the diameters of which are in a common plane substantialy parallel to the extension cords when assembled and arranged to receive said cord between said convolutions in clamping relation and spaced with respect to one another a distance greater than the combined length of the connection ends of the extension cords.

2. The extension clip set forth in claim 1 and wherein said rod and the coiled ends are formed of resilient material.

3. The extension cord clip of claim 1 and wherein said rod and the coiled ends are formed of spring steel.

4. The extension cord clip of claim 1 and wherein said rod and the coiled ends are formed of spring steel and an enveloping friction coating is formed thereover.

5. The extension cord clip set forth in claim 1 and wherein the center portion of the rod is of an elongated flattened V-shape between said coiled ends.

* * * * *